US009569964B2

(12) United States Patent
Vaquin et al.

(10) Patent No.: US 9,569,964 B2
(45) Date of Patent: Feb. 14, 2017

(54) WARNING SYSTEM FOR ADVISING OF DANGEROUS SITUATIONS IN AN AGRESSIVE SETTING

(75) Inventors: Gilles Vaquin, Guichainville (FR); Olivier Grenier, Martainville (FR); Jean-Michel Baert, Le Thuit Signol (FR); Denis Doubremelle, Boos (FR)

(73) Assignee: PROXIPI, Saint Etienne du Rouvray (FR)

( * ) Notice: Subject to any disclaimer, the term of this patent is extended or adjusted under 35 U.S.C. 154(b) by 321 days.

(21) Appl. No.: 14/129,788

(22) PCT Filed: Jun. 26, 2012

(86) PCT No.: PCT/EP2012/062308

§ 371 (c)(1), (2), (4) Date: Dec. 27, 2013

(87) PCT Pub. No.: WO2013/000888

PCT Pub. Date: Jan. 3, 2013

(65) Prior Publication Data

US 2014/0139356 A1 May 22, 2014

(30) Foreign Application Priority Data

Jun. 29, 2011 (FR) ..... 11 55814

(51) Int. Cl.
*G08G 1/09* (2006.01)
*G08G 1/0967* (2006.01)
(Continued)

(52) U.S. Cl.
CPC ..... *G08G 1/096766* (2013.01); *G08B 21/02* (2013.01); *G08G 1/16* (2013.01)

(58) Field of Classification Search
CPC ..... G08G 1/096766; G08G 1/16; G08B 21/02
(Continued)

(56) References Cited

U.S. PATENT DOCUMENTS 4,870,700 A 9/1989 Ormanns et al.
2006/0054691 A1 3/2006 Holloway et al.
(Continued)

FOREIGN PATENT DOCUMENTS

EP 0 933 747 A2 8/1999
EP 1 445 749 A1 8/2004
(Continued)

OTHER PUBLICATIONS

International Search Report for corresponding PCT/EP2012/062308.

*Primary Examiner* — Daryl Pope
(74) *Attorney, Agent, or Firm* — Sughrue Mion, PLLC

(57) ABSTRACT

The present invention relates to a warning system for advising of dangerous situations in an aggressive setting. The warning system for advising of dangerous situations in an aggressive setting comprises at least one radiofrequency beacon (3-9) and at least one radiofrequency badge (11-17). The beacon comprises a means (3, 5) for emitting a magnetic field wave. The badge comprises a means (13, 15) for receiving the magnetic field wave radiated by the beacon. The badge comprises a means (17) for emitting a wave at very high frequency, activated by the means (13, 15) for receiving the magnetic field wave radiated by the beacon and the beacon comprises a means (7, 9) for receiving the very high frequency wave emitted by the badge, said means (7, 9) for receiving the very high frequency wave activating a warning facility for advising of dangerous situations.

20 Claims, 4 Drawing Sheets

(51) Int. Cl.
*G08B 21/02* (2006.01)
*G08G 1/16* (2006.01)

(58) Field of Classification Search
USPC .... 340/539.1, 539.11, 539.13, 435, 436, 905
See application file for complete search history.

(56) References Cited

U.S. PATENT DOCUMENTS

| | | | | |
|---|---|---|---|---|
| 2008/0030335 | A1 | 2/2008 | Nishida et al. | |
| 2008/0272914 | A1 | 11/2008 | Murray et al. | |
| 2009/0009322 | A1 | 1/2009 | Ramirez et al. | |
| 2010/0289662 | A1* | 11/2010 | Dasilva ..... | F16P 3/147<br>340/686.6 |
| 2011/0249118 | A1 | 10/2011 | Bruno | |

FOREIGN PATENT DOCUMENTS

| | | | |
|---|---|---|---|
| FR | 2 886 440 | A1 | 12/2006 |
| WO | 2006/128991 | A1 | 12/2006 |
| WO | 2007/149169 | A2 | 12/2007 |

* cited by examiner

WARNING SYSTEM FOR ADVISING OF DANGEROUS SITUATIONS IN AN AGRESSIVE SETTING

CROSS REFERENCE TO RELATED APPLICATIONS

This application is a National Stage of International Application No. PCT/EP2012/062308 filed Jun. 26, 2012, claiming priority based on French Patent Application No. 11-55814 filed Jun. 29, 2011, the contents of all of which are incorporated herein by reference in their entirety.

The present invention relates to a warning system for advising of dangerous situations in an aggressive setting. The dangerous situations include the risks of collision between a pedestrian and a vehicle. A setting is taken to be aggressive when it introduces disturbances which prevent the correct operation of the warning system, particularly in the transmissions of radioelectric waves.

In the prior art, vehicles are known which are specially designed to travel around in workshops or warehouses amid a population of pedestrians, generally professionals who work in the warehouse or the workshop. A collision between a vehicle and a pedestrian may have serious consequences. Now, because of the crowdedness of such sites, the vehicle which moves in an aisle of the warehouse or workshop, may not have any visibility as regards the approach of a pedestrian and the risk of collision increases with the speed of the vehicle, the narrowness of the zones and the nooks and crannies rendering the vehicle and the pedestrian invisible to one another.

To reduce the risk of collision, it is known to furnish the pedestrian with a radiofrequency badge and the vehicle with a beacon making it possible to interrogate the badge of the pedestrian remotely. The badge and the beacon then form a system for preventing collisions of radiofrequency type. Examples of such embodiments in the prior art can be found in the documents: WO 2006/128991, EP-A-0,933,747, WO2007/149169, US2006/054691, U.S. Pat. No. 4,870,700, US2008/030335 (A1), US2009/009322 (A1), EP-A-1,445,749, US2008/272914 (A1).

This prior art gives rise to at least one first problem in that the badge being a portable electronic object, it consumes energy. A second problem to which this prior art gives rise, when this energy is produced by an electrical accumulator or cell, resides in the risk of this energy being exhausted. This situation further aggravates the risk of collision since the two protagonists of the risk, the pedestrian and the vehicle, may believe they are relatively protected by the collision prevention system, whereas they no longer are.

It is known in such a system for preventing collisions of radiofrequency type to reduce the consumption of such badges, for example by turning them on only during situations of danger. Thus, it has already been proposed to start up the badge only when the pedestrian is moving, for example by detecting the walking state with a switch activated by the stride of the pedestrian, and by then turning on the badge. But the risk of exhaustion of the cell is merely reduced.

Another problem of the systems for preventing collisions of radiofrequency type resides in industrial or similar warehouses and workshops. Indeed, these partially or completely covered sites are generally occupied by metallic structures which considerably impede the propagation of the radiofrequency waves used by the beacon-badge pairs of the system for preventing collisions of radiofrequency type for presence detection. Particularly, the detection zones consisting of the zones in which a detection of a badge by a beacon is correct, may be restricted and deformed, and in a manner which is not constant either in time or during the movement of the vehicle in the workshop or warehouse.

The present invention affords a remedy to these drawbacks of the prior art. Indeed, it relates to a warning system for advising of dangerous situations in an aggressive setting, comprising at least one beacon and at least one badge that are carried by two vectors presenting a danger to one another. According to the invention, the beacon comprises a means of emission of a magnetic detection wave and the badge comprises a means of reception of the magnetic detection wave radiated by the beacon.

Advantageously, the initialization of the warning system is executed by using a magnetic wave and not an electromagnetic wave, as is the case in numerous data communications techniques. Particularly, the warning system operates for the whole of its initialization phase by near-field radiation with a working distance substantially corresponding to the wavelength of the magnetic wave in the surrounding medium.

According to another characteristic, the means of emission of a magnetic detection wave works at low frequency, between 25 and 150 KHz, and preferably between 50 KHz and 125 KHz and it comprises an auto-oscillator dimensioned so as to produce a safe operating area including any emission pattern matched to disturbances of the aggressive setting.

According to another characteristic, the means of emission of a magnetic detection wave comprises a generator of a message comprising an identifier of the beacon so that the emission means produces a magnetic wave coded by said message comprising an identifier of the beacon.

According to another characteristic, the means of emission of a magnetic detection wave comprises a magnetic antenna comprising at least one conducting turn which is configured to produce a determined zone of magnetic detection around said beacon.

According to another characteristic, the badge also comprises warning means activated by the means of reception of the magnetic detection wave radiated by the beacon and which comprise separately or in combination from one to three effectors:

- a sound effector such as a miniature loudspeaker;
- a visual effector such as a light-emitting diode; and
- a kinesthetic effector such as a vibrator coupled acoustically with an external wall of the casing of the badge.

According to another characteristic, the badge comprises a means of emission of an ultra-high frequency wave automatic acknowledgment, activated by the means of reception of the magnetic detection wave radiated by the beacon and the beacon comprises a means of reception of the ultra-high frequency wave automatic acknowledgment emitted by the badge, said means of reception of the ultra-high frequency wave acknowledgment activating a dangerous situations warning facility.

According to another characteristic, the badge comprises an electrical power supply connected to the electrical circuits of the badge under the control of a wakeup circuit for the electrical power supply, activated by the means of reception of the low-frequency magnetic detection wave.

According to another characteristic, the means of reception of the magnetic detection wave radiated by the beacon comprises from one to three plane antennas whose normal directions are disposed in the directions of a trihedron, so that the orientation of the badge is immaterial in the field of the magnetic detection wave radiated by the beacon.

According to another characteristic, the means of emission of a magnetic detection wave of the beacon comprises a generator of message frames according to a predetermined protocol and the message comprising at least one identifier of the beacon.

According to another characteristic, the generator of frames produces a frame followed by a silence time so as to leave the channel to other means of emission of a magnetic detection wave and to receive a response of automatic acknowledgment of at least one badge disposed in the determined zone of magnetic detection around the beacon.

According to another characteristic, the beacon also comprises:

- a means of emission on the UHF channel of a request for UHF channel capture;
- a means of placing the UHF channel in listening mode;
- a means for detecting a request for UHF channel capture which comprises a circuit for detecting the start of a period T of the communication protocol;
- a circuit for determining whether a request for UHF channel capture of another beacon #y is received outside of the capture period whose output is connected to a control circuit for initializing the communication between the beacon #x and the badges #1 to #n that might possibly be present in the zone of the beacon.

According to another characteristic, at least one beacon comprises all or part of the resources of a badge.

According to another characteristic, at least one badge comprises all or part of the resources of a beacon.

According to another characteristic, the system comprises at least one beacon disposed at a determined site so as to generate an inhibition zone delimited by the determined zone of magnetic detection around the inhibition beacon, the inhibition beacon being endowed with a determined and known identifier of the beacons and/or badges of the system so that at least one badge receiving the magnetic detection wave arising from the inhibition beacon and recognizing the identifier of the inhibition beacon comprises a means for producing at least one of the following orders:

- an order disconnecting the warning means of the receiver badge so that they remain inactive;
- an order disconnecting the UHF modulator of the badge so that beacons no longer receive the automatic acknowledgment of the badges disposed in the inhibition zone generated by the inhibition beacon.

According to another characteristic, each beacon is mounted on at least one moving object so as to detect collision situations when the moving objects enter a zone common to the determined zones of magnetic detection around each beacon mounted on a moving object, each beacon comprising at least one means of reception of the magnetic detection wave emitted by another beacon mounted on a vehicle, and a means for generating an automatic acknowledgment as an ultra-high frequency (UHF) wave.

According to another characteristic, at least one beacon comprises a group of several plane antennas for receiving the magnetic detection wave which are disposed so that their normal directions are uniformly distributed in the plane of displacement of the moving object on which the beacon is mounted.

According to another characteristic, beacons are mounted on vectors comprising in particular:

- handling and/or logistics vehicles intended for warehouses, stores, workshops;
- vehicles for agricultural works, public works, civil engineering, and/or the mining industries;
- vehicles deployed in airport zones or maritime or river port installations;
- ships maneuvering in channels, rivers, maritime port zones.

According to another characteristic, a beacon is disposed at a fixed point, such as a reference point so as to form a characteristic zone covered by the zone of action of the LF magnetic detection wave generated by the beacon, such as an X-ray radiography installation and the personnel being furnished with badges so as to warn at one and the same time the personnel entering the zone covered by the beacon and the personnel serving the industrial radiography installation of a situation of danger.

According to another characteristic, at least one badge is carried by vectors such as robots, or packaging palettes on a conveying line.

Other characteristics and advantages of the present invention will be better understood with the aid of the description and of the appended drawings, among which:

FIG. 1 represents a diagram of use of a basic system of the invention;

FIGS. 2*a* and 2*b* represent respectively a block diagram of a coded magnetic field generator according to the invention and a particular embodiment of a block of this generator used in a beacon according to the invention;

Figure 1:
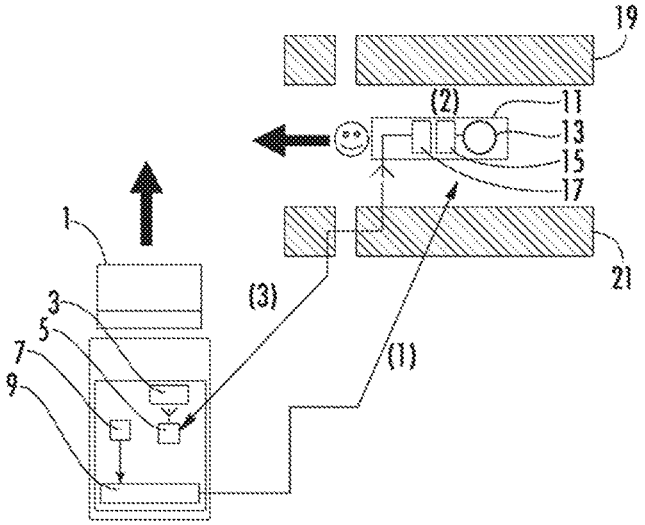

In FIG. 1 has been represented a diagram of use of a warning system for advising of dangerous situations in an aggressive setting in an embodiment of the invention. A handling vehicle 1 moves along the thick vertical arrow in the drawing in a workshop comprising structures 19 and 21 such as reinforced-concrete walls, girders made of steel or of other elements which at one and the same time prevent the driver of the vehicle 1 from seeing the approach of a pedestrian carrying a badge 11 and disturb the known radiofrequency systems. The pedestrian carrying the badge 11 moves along the thick horizontal arrow in the drawing, so that a risk exists of the vehicle and the pedestrian emerging at the same time from the aisle formed in the workshop between the structures 19 and 21. A risk of collision and fatal danger exists for the pedestrian.

According to the invention, the vectors presenting a danger to one another are: the vehicle 1 which carries an electrically powered beacon 3-9 and at least one pedestrian who carries a badge 11. The beacon comprises a magnetic detection wave emitter 7 coupled to a magnetic energy emission facility 9. Preferably, the magnetic energy emission facility 9 is embodied by a self-inductive antenna comprising a conducting frame traversed by an electric current delivered by the emitter 7 of a magnetic detection wave.

In one embodiment of the invention, the magnetic energy emission facility 9 works in a low-frequency LF frequency band.

The low-frequency LF magnetic detection wave is then radiated along the broken arrow (1) toward the badge 11 carried by the pedestrian passing through the aisle lying between the structures 19 and 21. The badge comprises a low-frequency matched antenna 13 connected to a low-frequency LF magnetic detection wave receiver 15.

In a particular embodiment, the warning system of the invention is embodied completely by adding, just to the badge carried by the pedestrian, danger warning means which can be polarized or energized by the badge reception energy or by an electrical energy accumulator. These warning means and the electrical power supply if appropriate are described further on.

In another, more complex, embodiment, the energy radiated by the magnetic detection wave emission facility 9 of the beacon 3-9 installed on the vehicle 1 is sufficient to polarize the circuits of the LF detection wave receiver 15. Once activated, the LF magnetic detection wave receiver 15 is connected to an input for activating a radiofrequency emitter 17 at ultra-high frequency of the UHF band, which is coupled to an antenna for emitting a UHF automatic acknowledgment or detection response wave. The UHF detection response wave is radiated (broken arrow (3)) toward the beacon 3-9 embedded on board the vehicle 1. The onboard beacon comprises a UHF reception antenna 5 which is connected to a UHF detection response wave receiver 5. The UHF detection response wave receiver 5 is coupled to a warning facility 3 for advising of dangerous situations which then signals at least to the driver of the vehicle of the occurrence of a dangerous situation, here a risk of collision with an invisible pedestrian carrying a badge according to the invention.

According to the invention, the antenna of the means or facility for emitting a magnetic detection wave and the electrical emission circuits are configured to generate a determined zone of magnetic detection around said beacon in which badges furnished with means for receiving the magnetic detection wave can be woken up or activated by the emission of the magnetic detection wave even in the absence of electrical power supply of the badge.

In one embodiment of the invention, the warning facility 3 comprises a man-machine interface, destined in particular for the driver of the vehicle on which the beacon is mounted. The man-machine interface is embodied by computing means with at least one screen for displaying texts and/or pictograms under the control of a computer programmed to activate the display screen with at least one text and/or at least one pictogram as a function of the dangerous situation detected by the automatic acknowledgment emitted by at least one badge. The man-machine interface also comprises if appropriate a sound resource comprising a loudspeaker for broadcasting an audible warning message.

In one embodiment of the invention, the LF magnetic detection wave receiver 15 comprises a circuit for decoding the magnetic detection wave arising (1) from the beacon onboard the vehicle. The circuit for decoding the LF magnetic detection wave is directly polarized by the energy radiated and received by the antenna 13, so that, when the decoding succeeds, an output terminal of the circuit for decoding the LF magnetic detection wave passes to an active electrical potential which makes it possible to close a switching circuit such as an electrical switch (not represented) which connects the remainder of the electrical circuits of the badge 11 to an electrical energy source such as an electric cell (not represented) inserted into the badge 11.

In one embodiment of the invention, the UHF band radiofrequency emitter 17 carried by the badge, also comprises a memory register in which is recorded in a known manner during fabrication or validation of the badge 11 a code which makes it possible to tag the UHF response of the badge carried by the pedestrian in the radiofrequency environment. The tagging code serves as modulation message for the radiofrequency emitter 17 of the UHF band and it is transmitted by the UHF wave (3) toward the onboard beacon UHF detection response wave receiver 5. The UHF detection response wave receiver 5 can thus decode the tagging code with the aid of a demodulation circuit (not represented) and distinguish the signal received from parasitic signals so as to activate or otherwise by an appropriate output terminal of the UHF detection response wave receiver 5 the warning facility 3 for advising of dangerous situations only when at least one badge 11 has responded to the LF detection wave emitted.

In one embodiment of the invention, the badge 11 is itself endowed with warning means (not represented) which are coupled to the output terminal of the receiver of the LF detection wave emitted. These warning means comprise separately or in combination from one to three effectors for which the pedestrian is sensitive:

- a sound effector such as a miniature loudspeaker;
- a visual effector comprising a light-emitting diode; and
- a kinesthetic effector such as a vibrator coupled acoustically with an external wall of the casing of the badge 11.

Each effector is connected to the power supply source integrated into the badge 11, such as an electric cell or an accumulator, with its own switching circuit, a control terminal of which is connected to the output terminal of the LF detection wave receiver 15 so that on reception of the LF detection wave (1), the effector is activated so as to warn the badge carrier 11. In a particular embodiment, the danger warning means of the badge are polarized directly by the energy received by the means of reception of the magnetic wave of the badge.

In one embodiment of the invention, the beacon 3-9 embedded on board the handling vehicle 1 is equipped with a warning facility 3 for advising of dangerous situations, which principally comprises a sound warning unit comprising a loudspeaker and a luminous warning unit comprising at least one light-emitting diode. The sound and luminous warning units are activated by way of a switching circuit, a control terminal of which is connected to the output terminal of the UHF detection response wave receiver 5 so that the UHF response (3) of at least one pedestrian badge activates the warning facility, signaling at least to the driver of the vehicle 1 of the occurrence of a dangerous situation, here a risk of collision with a carrier of a badge such as the badge 11. In other embodiments, a switching circuit for the beacon 3-9 embedded on board the handling vehicle is coupled to a signaling facility of the vehicle such as a sound warning unit of the vehicle and/or a lighting lamp so that this signaling facility specific to the vehicle cooperates or serves to function as a dangerous situations warning facility. This solution is advantageous in particular in the case where the sound warning unit of the vehicle is sufficiently powerful to be heard by the badge carrier 11, it then being possible for such a badge not to be furnished with warning means.

Figure 2A:
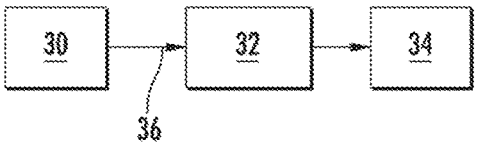

In FIG. 2*a* has been represented a particular embodiment of a part of the beacon embedded on board the vehicle 1 of FIG. 1. In this embodiment of the invention, during its fabrication or its initialization when it is installed and/or started up on board the vehicle, the beacon receives an identifier so that the LF detection wave is modulated by the identifier characteristic of the beacon and/or of the vehicle on board which it is mounted. In this embodiment, the beacon comprises a magnetic field generator coded by the identifier of the beacon. The coded magnetic field generator principally comprises a generator of frames 30 according to a predetermined communication protocol, each frame emitted by the generator of frames comprising the repetition of the identifier which serves as modulation message.

The signal arising from the generator of frames 30 is placed at the modulation input 36 of an auto-oscillator 32 whose carrier is chosen in a band of frequencies lying between 25 and 150 KHz and preferably between 50 and 125 KHz in an application for detecting situations of collisions between an automotive vehicle and a badges-carrying pedestrian.

The auto-oscillator exhibits the property of seeing its resonant frequency established by construction shifted toward the highest frequencies or the lowest frequencies as a function in particular of the parasitic impedance applied to the emission antenna by the environment. This parasitic impedance can be caused by the degree of humidity of the propagation medium, its temperature and especially by the magnetic susceptibility of the surrounding structures such as those 19 and 21 (see FIG. 1) which surround the zone of propagation of the magnetic energy radiated by a self-inductive antenna 34 connected to the output terminal of the auto-oscillator. By choosing components to embody the auto-oscillator whose power dissipation is matched to the environment of the propagation zone, the arbitrary presence of aggressive conditions of low-frequency transmission gives rise to only little negative effect in contradistinction to the modulators used in the prior art.

Figure 2B:
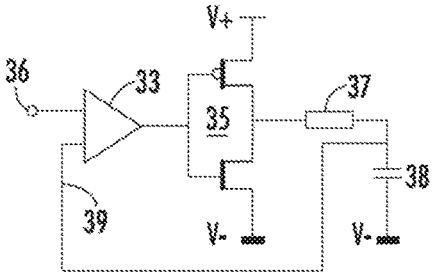

In FIG. 2*b* has been represented a particular embodiment of an auto-oscillator in accordance with the invention. The modulation input terminal 36 transmits the message frames comprising the repetition of the identifier of the beacon and/or of the vehicle to a first input of an operational amplifier 33 mounted as negative gain amplifier, preferably of gain equal to the value "−1". The output of the amplifier 33 is connected to the gates of a pair 35 of complementary MOS transistors which, through their common terminal, charge a magnetic antenna composed of a self-inductive frame 37 whose other terminal is connected to the electrical earth "V−" of the coded magnetic field generator by way of a capacitor 38. The resonant frequency of the auto-oscillator is chosen in particular on the basis of the impedance of the magnetic antenna and of the capacitance of the capacitor 38 during the design of the beacon and/or by adaptation during the mounting thereof on the vehicle.

The auto-oscillator finally comprises a feedback action on the second input terminal of the amplifier 33 of the common point between the antenna 37 and the tuning capacitor 38. The pair of complementary MOS transistors is polarized between the positive power supply "V+" and the electrical earth "V−" of the coded magnetic field generator.

Figure 3:
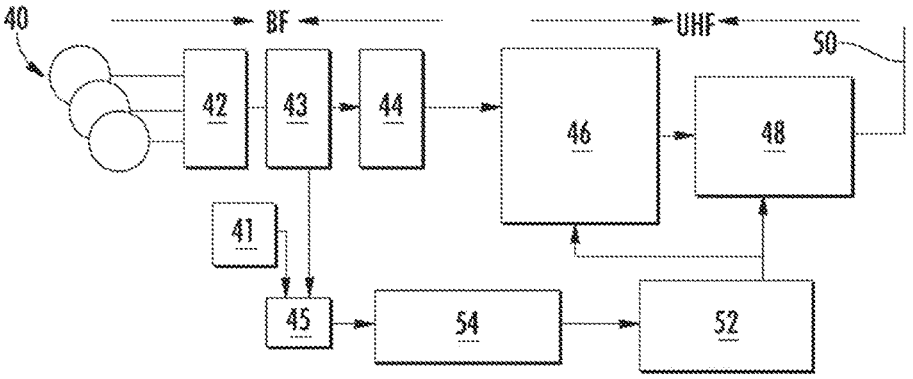
FIG. 3 represents a block diagram of an embodiment of a badge according to the invention.

In FIG. 3 has been represented a block diagram of an embodiment of a badge according to the invention. At least one magnetic antenna 40 is disposed inside the badge. In a preferred embodiment such an antenna is constituted by at least one plane turn of a conductor or by a stack of plane turns all having the same normal direction. These turns can be associated according to various electrical setups as a function of circumstances of use of the badge of the invention. In a preferred embodiment, three magnetic antennas such as that described hereinabove are coupled together and their normal directions are distributed according to a trihedron in space so that the orientation of the badge in which the three antennas are mounted becomes immaterial.

The coupling of the antennas is carried out by an electrical combiner 42 whose output is connected to the input of a bandpass filter on the LF Low-Frequency band in which the beacon with which the badge is associated works. Such a band LF lies between 25 and 150 KHz and preferably between 50 and 125 KHz. The output of the bandpass filter 43 is transmitted to the input of a demodulator 44 of the LF Low-Frequency detection wave emitted by the coded magnetic field generator of the beacon (see FIGS. 1 and 2). The LF demodulator 44 is constructed as a function of the coded magnetic field generator of the beacon with which the badge is associated.

An output of the bandpass filter 43 is transmitted to a comparator 45, another input of which is connected to a reference voltage generator which can be programmed during the configuration of the badge or controlled in an adaptive manner so as to adjust the sensitivity of the wakeup of the badge as a function of the reception conditions present just where the badge and/or the beacon emitting the LF low-frequency magnetic detection wave are/is situated. The output of the bandpass filter 43 used for the detection of badge wakeup is chosen on a point of the electrical circuit of the filter 43 which attains levels of voltage which is sufficient at an instant that is as early as possible during the detection of the magnetic waves picked up by the antennas 40 of the badge. When the voltage selected on the circuit of the bandpass filter 43 is at least equal to the reference voltage generated by the reference voltage generator 41, the output voltage of the comparator 45 toggles and is connected to the activation input for a wakeup circuit 54 for the power supply of the badge.

The main output of the bandpass filter 43 is then transmitted to a demodulator 44 which makes it possible to extract the message bits transmitted by the beacon toward the set of badges present in the beacon emission zone.

In one embodiment, the beacon executes a modulation of ASK type on the low-frequency magnetic pathway. In relation, the demodulator 44 of the badge is therefore an ASK type modulation demodulator. Good results have been obtained with an OOK modulation, which is a variant of the ASK modulation and with a modulation of NRZ type. The demodulator of the badge is then selected as OOK or NRZ modulator according to circumstance. In the case of an OOK modulation, in the 25 KHz-150 KHz LF emission band, bitrates of 500 bits/second to 1,000 bits/second have been successfully transmitted, depending on the aggressivity of the medium in which the Low-Frequency magnetic link is established.

The output of the demodulator 44, which comprises the decoded data received from the message transmitted by the beacon in the LF magnetic detection wave is transmitted to the input of a generator 46 carrying out an automatic acknowledgment of the LF detection performed by the LF low-frequency detection wave emitted ((1) FIG. 1) by the beacon. The acknowledgment message is generated on the basis of the message decoded by the demodulator 44. It is moreover noted, that the decoded dataset also constitutes an activation signal for the danger warning or alarm means carried by the badge, so that the carrier of the badge is warned of the presence of a beacon and/or of the vehicle or other vector of the beacon. These warning means are supplied directly by the badge's internal electrical power supply which is woken up or activated by the wakeup circuit 54.

The automatic detection acknowledgment generator produces an acknowledgment message on its output terminal which is connected to an input terminal of an ultra-high frequency modulator in the UHF regulatory band. The automatic detection acknowledgment generator comprises a means (not represented in FIG. 3) for synchronizing with the protocol of frames emitted in the LF low-frequency band by the coded magnetic field generator so that the acknowledgment response in the UHF regulatory band is synchronized as will be described further on.

To this end, the request for synchronization of the generator of automatic acknowledgment of detection is transmitted at least to a UHF receiver means making it possible to give a command for synchronization of the UHF frames produced by the acknowledgment generator 46. The UHF synchronization receiver means is, in an embodiment of the invention, implemented in a UHF transmitter-receiver of the beacon with which the badge is intended to be associated. It receives the request for synchronization of the badge and, in response, elaborates a command for synchronization of UHF frames for the requesting badge as a function of the frames generation performed by the generator of coded frames 30 of the coded magnetic field generator (FIG. 2). This command for synchronization of UHF frames is then transmitted to the requesting badge, a UHF receiver (not represented) of which makes it possible to receive the synchronization command.

The automatic detection acknowledgment message generator 46 is connected to the input terminal of an ultra-high frequency modulator 48 in the UHF regulatory band which drives a UHF antenna 50 of the badge (11 FIG. 1). The UHF modulator 48 is embodied on the basis of an off-the-shelf circuit.

In one embodiment of the invention, an output of the broadband low frequency modulator 44 of the badge is also connected to a wakeup circuit 54 for the electrical power supply 52 of the remainder of the electrical circuits 46, 48 of the badge. Such a circuit is, in an embodiment, embodied by a switching circuit which connects the power supply terminals of the electrical circuits 46, 48 of the badge to an electrical power supply 52 comprising an electric cell. After a period of inactivity on the output of the demodulator 44, the wakeup circuit 54 switches back to the inactive state and the electrical power supply 52 is again disconnected from its load. A significant reduction in electrical consumption at the level of the badge is thus achieved.

In FIG. 3, the warning means integrated into the badge have not been represented. As has been described above, these warning means comprise from one to three effectors taken from among a loudspeaker, a display and a vibrator. Each of them is controlled if appropriate by way of a switching circuit whose control input is connected to the output terminal of the broadband LF demodulator 44 and/or by programming, and/or connected during the configuration of the badge during its commissioning into service. When the switching circuit is closed, the current of the electrical power supply 52 of the badge (accumulator, cell) passes through the controlled warning means. In another embodiment, it is directly the energy of reception of the magnetic detection wave received by the badge which serves to polarize the warning means.

Figure 4:
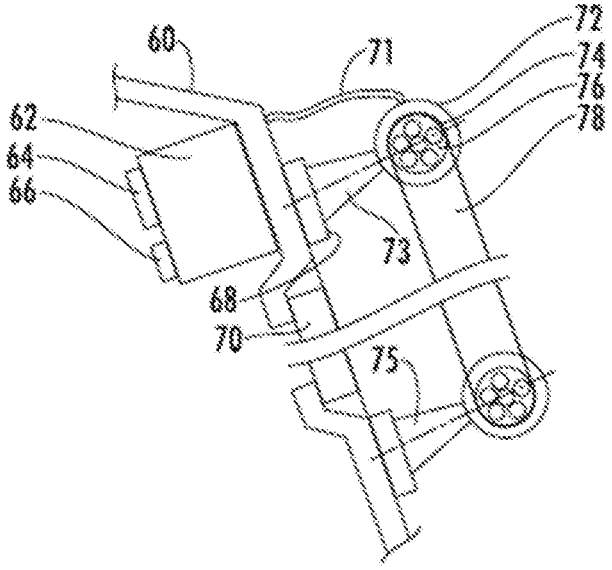
FIG. 4 represents a block diagram of an embodiment of a beacon installed on a vehicle or handling carriage according to the invention.

In FIG. 4 has been schematically represented a beacon installed on a handling vehicle in an embodiment according to the invention.

The chassis 60 of the vehicle comprises a substantially vertical wall on the exterior of which is disposed a magnetic antenna 78 made up of a multiturn frame 76 enclosed in an insulating sheath 74. The magnetic antenna 78 is connected by a sheathed electrical cable 71 to a box 62 in which the beacon proper is installed, such as described in particular in FIGS. 1 and 2*a*. The electrical cable 71 is linked to the box 62 of the beacon by a leaktight passage passing through the substantially vertical wall of the chassis 60 of the vehicle. It is linked to the auto-oscillator (FIG. 2) of the beacon's coded magnetic field generator.

Moreover, the self-inductive antenna 78 is mounted on brackets 72, 73 distributed over plinths fastened to the substantially vertical wall of the chassis 60, around the windshield 70 mounted on this wall. Each bracket such as the bracket 71 comprises a free end bearing a cylindrical support 72 which passes around the cable 74 constituting the frame forming the antenna. The cable 74 is composed of several strands such as the strand 76, each forming a turn of the self-inductive antenna 78. The turns can be connected according to a multitude of diagrams for electrical connection with the output of the auto-oscillator (32, FIG. 2) so as to shape the radiation pattern of the antenna 78 during its mounting on the chassis 60 of the vehicle.

Figure 5:
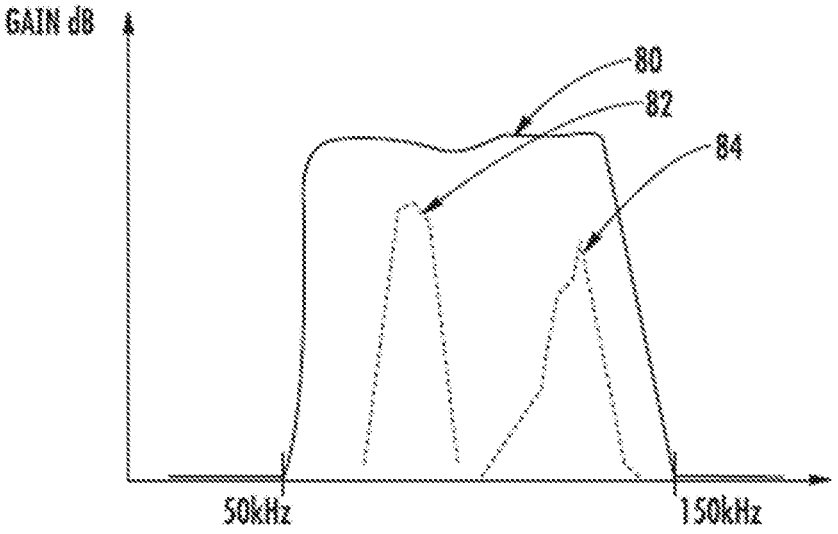
FIG. 5 represents a chart explaining the operation of the principle of the invention.

In FIG. 5 has been represented a chart explaining the operation of the principle of the invention.

Plotted as abscissa is the spectrum of the radioelectric low frequencies and as ordinate the weakening gain in dB. The pattern 80 represents the safe operating zone of the auto-oscillator (FIGS. 2*a* and 2*b*) of the coded magnetic field generator. The pattern 82 represents the pattern of free-field radiated power with the auto-oscillator of the invention and the pattern 84, the pattern of power radiated in an aggressive environment, such as in the workshop with metallic structures (19, 21: FIG. 1).

By carrying out appropriate dimensioning of the components of the auto-oscillator (32, FIG. 2*a*; 36-39, FIG. 2*b*) it is possible to obtain a broad band 25 KHz-150 KHz of safe operation so that the presence of disturbances caused by an aggressive setting is not responsible for a destruction or degradation of the beacon, as shown by the pattern 84 which is included in the safe operating zone 80 of the auto-oscillator.

Figure 6:
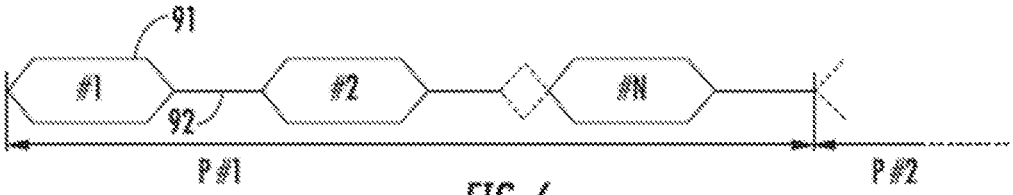
FIG. 6 represents a chart of a transmission protocol for a magnetic wave.

In FIG. 6 has been represented a chart of a protocol for generating a magnetic wave used in the generator of coded frames (30, FIG. 2*a*). The time required to place a coded message according to the protocol adopted is determined during a fraction of period P#1 marked by the zone 91 for the first frame #1. Next, a silence time is envisaged during a period 91 and a second frame #2 can then be emitted. During a period P#1, N frames from #1 to #N can be generated, so that up to N beacons can be competing in one and the same reception zone.

Next, a later period P#2 is opened and so on and so forth.

In one embodiment, there is provision for a period P#1 of 1 second to transmit several other frames #1 to #3, allowing other beacons to emit in their turn in the same zone.

Figure 7:
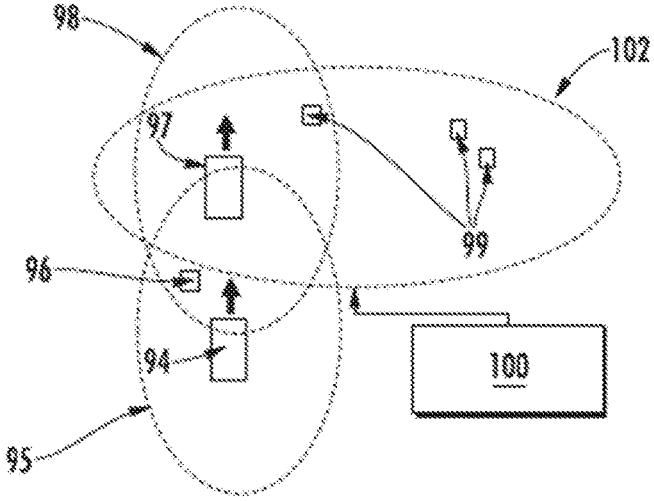
FIG. 7 represents an embodiment of a collision prevention inhibition zone.

In FIG. 7 has been represented a mode of carrying out the inhibition of the warning in a particular zone. When a beacon detects too high a number of badges during its displacement, a warning becomes relatively inoperative and the danger of collision with a pedestrian who is nevertheless carrying a badge increases.

To at least partly remedy this drawback, provision is made to dispose at determined positions at least one specialized beacon which generates a zone of inhibition of the warning produced by the beacons on board the vehicles. Situations other than beacons on vehicles can also benefit from the inhibition zone.

In the embodiment of FIG. 7, a warning inhibition beacon 100 is disposed which generates an LF magnetic detection wave as has been taught with the aid of FIGS. 1 to 2*b* and 6. When badges 99 are situated in the zone 102 covered by the LF magnetic detection wave generated by the beacon 100, they detect the identifier of the inhibition beacon. A memory register installed in each badge is loaded with the list of identifiers of the inhibition beacons. During the decoding of the beacon identifier which is loaded into the message modulating the LF magnetic detection wave, the badge comprises a means for comparing the identifier received by the LF receiver with the list recorded in the register of identifiers of the inhibition beacons.

In response to the comparison, the means for comparing the decoded identifier with the list of inhibition beacons can produce at least one of the following orders:

- an order disconnecting the warning means of the receiver badge so that they remain inactive;
- an order disconnecting the UHF modulator (48, FIG. 3) of the badge so that the vehicles equipped with beacons no longer receive the automatic acknowledgment of the badges 99 disposed in the inhibition zone 102 generated by the inhibition beacon 100.

To this end, each badge is endowed with:

- a circuit for switching the warning means of the badge, said circuit being connected to a means for comparing the decoded identifier with the list of inhibition beacons;
- a switching circuit making it possible to disconnect the input terminal of the automatic acknowledgment generator (46, FIG. 3) from the output terminal of the LF broadband demodulator (44, FIG. 3), said circuit being connected to the means for comparing the decoded identifier with the list of inhibition beacons.

In one embodiment of the invention, the means for comparing the decoded identifier with the list of inhibition beacons is connected to the output terminal of the LF broadband demodulator (44, FIG. 3) of the badge.

Thus, returning to FIG. 7, when a vehicle equipped with a beacon as has been described with the aid of FIGS. 1 and 2 in particular, is traveling outside of the inhibition zone, for example in the position 94, the beacon generates a zone of coverage of the LF magnetic detection wave 95. If a badge carried for example by a pedestrian 99 is situated in the zone 95, it will be signaled to the beacon of the vehicle in position 94. Next, the vehicle continuing its trajectory, enters, at position 97, the inhibition zone 102 generated by the inhibition beacon 100, its beacon generates a zone of coverage of the LF magnetic detection wave 98. A badge, carried for example by a pedestrian from among the badges 99, and disposed in the intersection of the inhibition zone 102 and of the coverage zone 98, will be undetectable by the beacons.

Figure 8:
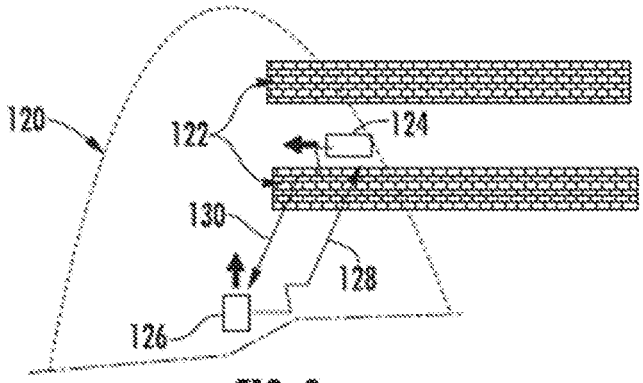
FIG. 8 represents a situation diagram for an application to the prevention of collision between at least two vehicles.

In FIG. 8 has been represented a situation diagram for an application to the prevention of collision between at least two vehicles.

In the situation where two vehicles 124 and 126 are traveling in proximity to one another, but out of each other's view, a risk of collision is possible and can be signaled by the beacons of the invention. In this case, each beacon is also endowed with a broadband LF demodulator which allows it to detect a coded magnetic detection wave emitted by another vehicle. The broadband LF demodulator is absolutely analogous to the demodulator 44 of the badge described with the aid of FIG. 3 and the beacon then also comprises an automatic acknowledgment message emission chain analogous to the chain 46-50 of the badge of FIG. 3.

Using these means, the beacon of the vehicle 126 generates a zone of coverage of the LF magnetic detection wave 120 in which is situated the beacon, of the vehicle 124, equipped with the means of LF reception and UHF emission of automatic acknowledgment of a badge. The beacon of the vehicle 126 generates an LF magnetic detection wave 128 which is then received by the magnetic antenna (or antennas) of the beacon of the vehicle 124.

The LF demodulator of the detection wave then decodes the identifier of the beacon of the vehicle 126 in the beacon of the vehicle 124 and its output terminal activates:

- warning means analogous to those provided for in the badge described with the aid of FIG. 3 so that the driver of the vehicle 124 is warned of a risk of collision with the vehicle 126 whose trajectory is masked therefrom by the obstacles 122 between which it is traveling and
- the automatic acknowledgment UHF emission chain analogous to that of a badge and described in FIG. 3.

The automatic acknowledgment UHF emission chain of the beacon of the vehicle 124 then emits the automatic acknowledgment message 130 which is then received by the UHF reception antenna of the beacon of the vehicle 126 which is decoded by the UHF reception chain installed in the beacon of the vehicle 126 and which is analogous to the chain for UHF reception of the automatic acknowledgment of a beacon described with the aid of FIG. 1, in fact as if the beacon of the vehicle 124 were a badge interrogated and woken up by the beacon of the vehicle 126. In response the warning facility of the beacon of the vehicle 126 is activated and the driver of the vehicle 126 is likewise warned of a risk of collision.

It is noted that, if the beacons of the vehicles 124 and 126 are furnished with the same communication means, the vehicle 124 likewise emits a magnetic detection wave destined for the vehicle 126 which will likewise respond like a badge. It is then noted that the collision prevention detection takes place twice in parallel for each vehicle, thereby strengthening the reliability of the danger situations warning system of the invention.

In the application of FIG. 8, the beacon for detecting the risk of collision between vehicles must have a strengthened LF magnetic detection wave zone of action. Provision is then made for the LF magnetic detection wave reception antenna to be different from the version described for a badge like that defined in FIG. 3. Indeed, most of the time the vehicle, like the vehicle 124 or 126, is disposed in a plane and it is not useful to provide for a reception magnetic antenna whose normal direction is directed along the vertical at the site. In a preferred embodiment, provision has been made to dispose three antennas whose normal directions lie substantially in the plane of displacement of the vehicle and form an angle of 120° between them. This therefore avoids favoring a direction of collision in the plane of displacement of the vehicle.

Figure 9:
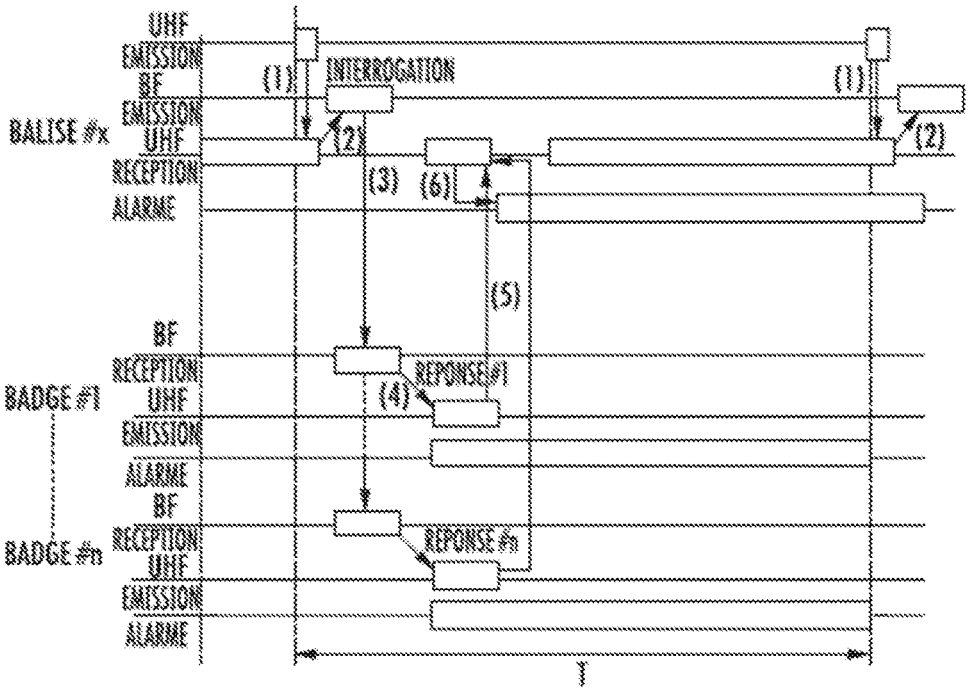
FIG. 9 represents a timechart of dialog between a beacon and a plurality of badges for warning system according to the invention.

FIG. 9 represents a timechart of dialog between at least one beacon and a plurality of badges for warning system according to the invention.

The first four lines refer to a beacon denoted "Beacon #x". The first line describes the emission on the UHF channel which has been previously described with the aid of FIG. 2*a* in particular. The second line describes the emission of an LF low-frequency magnetic detection frame which is repeated according to the protocol described with the aid of FIG. 6. The third line describes the reception on the same UHF channel as that in emission on the first line, of an automatic acknowledgment wave for at least one badge woken up by the magnetic detection frame of the first line. The fourth line indicates the state of the alarm associated with the beacon #x.

It is understood that several beacons can share a common reception zone in respect of the LF magnetic detection wave. It follows from this that provision must be made for a line capture mechanism on the UHF channel in particular so that a beacon can emit alone during at least one frame of the protocol defined here. This is the role of the first UHF emission line for the beacon #x. Like all the beacons of the warning system of the invention the beacon #x permanently places its UHF channel in permanent listening mode (third line for the beacon #x). If it receives a UHF emission produced by another beacon whilst its own period T for executing the protocol has not ended, the beacon #x infers that another beacon #y is in the process of requesting the UHF channel in emission. It disables its emission, if any, of an LF magnetic detection wave. And it remains in UHF listening mode.

If the beacon #x has emitted at the date t=0 which identifies the start of the period T of its protocol for dialog with the badges and the other beacons, if any, that might be disposed in the same reception zone, a UHF channel capture request message, it receives this message itself and then triggers an interrogation (2) which instructs an emission of an LF magnetic detection wave by the beacon #x, the other beacons #y, if any, remaining mute at least on the LF channel.

The LF magnetic detection wave is then received (3) by the LF receivers of the badges #1 to #n if n badges are disposed in the zone.

The group of trios of lines that follow relates to the radiofrequency activity of a group of N badges lying at the same time in the zone of coverage of the magnetic detection wave emitted by the beacon "Beacon #x". Each badge referenced from "badge #1" to "badge #n" receives (3), on the line of FIG. 9 marked "LF Reception", the same interrogation or detection frame produced by the beacon "Beacon #x" almost simultaneously with its emission. The frame is received as has been described with the aid of FIG. 3, by the broadband demodulator (44, FIG. 3) of the LF Low-Frequency detection wave emitted by the coded magnetic field generator of the beacon "Beacon #x".

Next, the automatic acknowledgment UHF emission chain of each badge "Badge #1" to "Badge #n" is activated by "Response #1" to "Response #n" and generates (4) the acknowledgment message on the UHF communications network of each badge "Badge #1" to "Badge #n" with the emitter or detector beacon "Beacon #x" as destination (5). Simultaneously with the UHF response, the badge #1 to #n activates its alarm means.

The beacon #x which generated the LF magnetic detection wave then receives the responses Reponse#1 to Response #n of the n badges present and it activates (6) its own alarm means as has been described above.

It is thus noted that the detector beacon of the badges present in its zone of coverage receives an arbitrary number of automatic acknowledgments. Reception of a single automatic acknowledgment suffices for signaling of the warning of a situation of danger to be triggered on the beacon.

To manage UHF channel capture, each beacon therefore comprises a means of emission on the UHF channel of a request for UHF channel capture and a means of placing the UHF channel in listening mode. A means for detecting a request for UHF channel capture comprises a circuit for detecting the start of a period T of the communication protocol of the warning system of the invention and a circuit for determining whether a request for UHF channel capture of another beacon #y is received outside of the capture period. The output of the circuit for determining whether a request for UHF channel capture is then connected to a control circuit for initializing the communication between the beacon #x and the badges #1 to #n that might possibly be present in the zone of the beacon, so that if another request for UHF channel capture has been presented by another beacon #y, a period of inhibition of the emission of the magnetic detection wave is initiated and if no other request for UHF channel capture has been presented by another beacon #y, the communication is initialized by the emission of an LF magnetic detection wave.

Depending on the circumstances, some or all of the resources of a beacon described above are set up on a badge. Conversely, as has been described in respect of the beacons for preventing collision between vehicles, some or all of the resources of at least one badge are set up on a beacon.

It is noted that the warning system for advising of dangerous situations in an aggressive setting of the present invention finds application in the prevention of collisions between any two vectors. Indeed, the warning means with which the badge and/or the beacon are/is equipped make it possible to warn at least one of the vectors of a risk of collision. But the invention also finds application in anti-collision devices in that the warning means can be coupled as has been described in the case of a beacon mounted on a handling vehicle, with actuators of the motion of the vehicle such as brakes which make it possible to prevent collision.

It is noted that the handling vehicle which has been described as carrying a beacon can be replaced depending on the circumstances of application of the invention by other kinds of vehicles, among which:

- handling and/or logistics vehicles intended for warehouses, stores, workshops;
- vehicles for agricultural works, public works, civil engineering, and/or the mining industries;
- vehicles deployed in airport zones or maritime or river port installations;
- ships maneuvering in channels, rivers, maritime port zones.

It is noted that the beacon can, as has been described in respect of the inhibition beacons (FIG. 7), be disposed at a fixed point, such as a reference point so as to form a characteristic zone covered by the zone of action of the LF magnetic detection wave generated by the beacon. In a particular application, the beacon is associated with an X-ray radiography installation making it possible to monitor welds or sheet metal in industrial vessels. In this particular application, the personnel working in a vessel undergoing X-ray monitoring are not aware of the zone of action of the X-rays generated by the radiography installation. By furnishing them with badges constituted as has been described with the aid of FIG. 3 in particular, and by linking a beacon constituted as has been described with the aid of FIGS. 1, 2*a*, 2*b* and 6 in particular, it is possible to warn at one and the same time the personnel entering the zone covered by the beacon and the personnel serving the industrial radiography installation of a situation of danger.

It is noted that the badge can, as has been described in particular in FIGS. 1 and 7, be carried by a pedestrian, or personnel. In other applications, the badge can be carried by other agents such as robots, or packaging palettes on a conveying line.

It is noted that other messages can be carried in the emissions of magnetic detection wave and/or automatic acknowledgments at ultra-high frequencies and/or for synchronizing the emission frames. In this case, means or resources for receiving these messages are connected to resources for utilizing such messages.

The invention claimed is:

1. A warning system for advising of dangerous situations in an aggressive setting, comprising at least one beacon and at least one badge that are carried by two vectors presenting a danger to one another, wherein the beacon comprises a means of emission of a magnetic detection wave and the badge comprises a means of reception of the magnetic detection wave radiated by the beacon; and wherein the badge comprises an electrical power supply connected to the electrical circuits of the badge under the control of a wakeup circuit for the electrical power supply, activated by the means of reception of the low-frequency magnetic detection wave of the badge.

2. The system as claimed in claim 1, characterized in that the means of emission of a magnetic detection wave works at low frequency, between 25and 150 KHz, and preferably between 50 KHz and 125 KHz and in that the system comprises an auto-oscillator dimensioned so as to produce a safe operating area including any emission pattern matched to disturbances of the aggressive setting.

3. The system as claimed in claim 1, characterized in that the means of emission of a magnetic detection wave comprises a generator of a message comprising an identifier of the beacon so that the emission means produces a magnetic wave coded by said message comprising an identifier of the beacon.

4. The system as claimed in claim 3, characterized in that the means of emission of a magnetic detection wave comprises a magnetic antenna comprising at least one conducting turn which is configured to produce a determined zone of magnetic detection around said beacon.

5. The system as claimed in claim 1, characterized in that the badge also comprises warning means activated by the means of reception of the magnetic detection wave radiated by the beacon and which comprise separately or in combination from one to three effectors:

a sound effector such as a miniature loudspeaker;

a visual effector such as a light-emitting diode; and a kinesthetic effector such as a vibrator coupled acoustically with an external wall of the casing of the badge.

6. The system as claimed in claim 1, characterized in that the badge comprises a means of emission of an ultra-high frequency (UHF) wave automatic acknowledgment, activated by the means of reception of the magnetic detection wave radiated by the beacon and the beacon comprises a means of reception of the ultra-high frequency (UHF) automatic acknowledgment wave emitted by the badge, said means of reception of the ultra-high frequency (UHF) automatic acknowledgment wave activating a dangerous situations warning facility.

7. The system as claimed in claim 1, characterized in that the means of reception of the magnetic detection wave radiated by the beacon comprises from one to three plane antennas whose normal directions are disposed in the directions of a trihedron, so that the orientation of the badge is immaterial in the field of the magnetic detection wave radiated by the beacon.

8. The system as claimed in claim 1, characterized in that the means of emission of a magnetic detection wave of the beacon comprises a generator of message frames according to a predetermined protocol and the message comprising at least one identifier of the beacon.

9. The system as claimed in claim 8, characterized in that the generator of frames produces a frame followed by a silence time so as to leave the channel to other means of emission of a magnetic detection wave and to receive a response of automatic acknowledgment of at least one badge disposed in the determined zone of magnetic detection around the beacon.

10. The system as claimed in claim 8, characterized in that each beacon also comprises:

a means of emission on the UHF channel of a request for UHF channel capture;

a means of placing the UHF channel in listening mode;

a means for detecting a request for UHF channel capture which comprises a circuit for detecting the start of a period T of the communication protocol;

a circuit for determining whether a request for UHF channel capture of another beacon #y is received outside of the capture period whose output is connected to a control circuit for initializing the communication between the beacon #x and the badges #1 to #n that might possibly be present in the zone of the beacon.

11. The system as claimed in claim 1, characterized in that at least one beacon comprises all or part of the resources of a badge.

12. The system as claimed in claim 1, characterized in that at least one badge comprises all or part of the resources of a beacon.

13. The system as claimed in claim 11, comprising at least one beacon disposed at a determined site so as to generate an inhibition zone delimited by the determined zone of magnetic detection around the inhibition beacon, the inhibition beacon being endowed with a determined and known identifier of the beacons and/or badges of the system so that at least one badge receiving the magnetic detection wave arising from the inhibition beacon and recognizing the identifier of the inhibition beacon comprises a means for producing at least one of the following orders:

an order disconnecting the warning means of the receiver badge so that they remain inactive;

an order disconnecting the UHF modulator of the badge so that beacons no longer receive the automatic acknowledgment of the badges disposed in the inhibition zone generated by the inhibition beacon.

14. The system as claimed in claim 11, characterized in that each beacon is mounted on at least one moving object so as to detect collision situations when the moving objects enter a zone common to the determined zones of magnetic detection around each beacon mounted on a moving object, each beacon comprising at least one means of reception of the magnetic detection wave emitted by another beacon mounted on a vehicle, and a means for generating an automatic acknowledgment as an ultra-high frequency (UHF) wave.

15. The system as claimed in claim 14, characterized in that at least one beacon comprises a group of several plane antennas for receiving the magnetic detection wave which are disposed so that their normal directions are distributed in a determined manner in the plane of displacement of the moving object on which the beacon is mounted.

16. The system as claimed in claim 1, characterized in that beacons are mounted on vectors comprising:

handling and/or logistics vehicles intended for warehouses, stores, workshops;

vehicles for agricultural works, public works, civil engineering, and/or the mining industries;

vehicles deployed in airport zones or maritime or river port installations;

ships maneuvering in channels, rivers, maritime port zones.

17. The system as claimed in claim 1, characterized in that a beacon is disposed at a fixed point, such as a reference point so as to form a characteristic zone covered by the zone of action of the LF magnetic detection wave generated by the beacon, such as an X-ray radiography installation and the personnel being furnished with badges so as to warn at one and the same time the personnel entering the zone covered by the beacon and the personnel serving the industrial radiography installation of a situation of danger.

18. The system as claimed in claim 1, characterized in that at least one badge is carried by vectors such as robots, or packaging palettes on a conveying line.

19. The system as claimed in claim 2, wherein the means of emission of the magnetic detection wave works at a frequency between 50 KHz and 125 KHz.

20. A warning system for advising of dangerous situations in an aggressive setting, comprising:

a beacon carried by a first vector; and a badge carried by a second vector, the first vector and the second vector at risk of colliding;

wherein the beacon comprises an emitter of a magnetic wave that generates a zone of magnetic detection around the beacon; and the badge comprises a receiver configured to detect the magnetic wave emitted by the beacon and an electrical warning system that is activated from an inactive dormant state by the detection of the magnetic wave.

* * * * *